US009234699B2

(12) United States Patent
Hall

(10) Patent No.: US 9,234,699 B2
(45) Date of Patent: Jan. 12, 2016

(54) GARMENT BAND

(71) Applicant: Arnold M. Hall, Normandy Park, WA (US)

(72) Inventor: Arnold M. Hall, Normandy Park, WA (US)

( * ) Notice: Subject to any disclaimer, the term of this patent is extended or adjusted under 35 U.S.C. 154(b) by 147 days.

(21) Appl. No.: 13/942,527

(22) Filed: Jul. 15, 2013

(65) Prior Publication Data

US 2014/0013613 A1 Jan. 16, 2014

Related U.S. Application Data

(60) Provisional application No. 61/741,219, filed on Jul. 16, 2012.

(51) Int. Cl.

| | |
|---|---|
| ***F26B 25/00*** | (2006.01) |
| ***F26B 21/00*** | (2006.01) |
| ***D06F 59/04*** | (2006.01) |
| ***F26B 9/00*** | (2006.01) |

(52) U.S. Cl.

CPC ..... *F26B 21/003* (2013.01); *D06F 59/04* (2013.01); *F26B 9/003* (2013.01); *F26B 21/008* (2013.01)

(58) Field of Classification Search

CPC ..... F26B 19/00; F26B 25/00; A41D 27/00; A41D 27/22

USPC ..... 34/103, 239; 15/4, 320

See application file for complete search history.

(56) References Cited

U.S. PATENT DOCUMENTS

| | | | | |
|---|---|---|---|---|
| 2,783,925 | A * | 3/1957 | Ross | 223/78 |
| 3,067,001 | A * | 12/1962 | McCollum | 422/28 |
| 4,084,733 | A | 4/1978 | Perlmutter | |
| 4,991,756 | A * | 2/1991 | Benjamin | 223/72 |
| 5,177,881 | A * | 1/1993 | Moore | 34/239 |
| 5,406,717 | A * | 4/1995 | Dofka | 34/104 |
| 5,983,518 | A | 11/1999 | Ellenburg | |
| 7,886,945 | B2 * | 2/2011 | Fitzgerald et al. | 223/85 |
| 7,895,768 | B2 * | 3/2011 | Vossoughi et al. | 34/60 |
| 8,079,156 | B1 * | 12/2011 | Parish | 34/103 |
| 2007/0086914 | A1 * | 4/2007 | Antinozzi | 422/28 |

* cited by examiner

*Primary Examiner* — Stephen M Gravini

(74) *Attorney, Agent, or Firm* — Dean A Craine

(57) ABSTRACT

An elongate flexible band may be formed into a self-adjusting closed loop for insertion into an opening in a garment. The loop expands against the sides of the garment opening, holding the garment open to enhance airflow into the garment. A loop connector limits the closed loop to a maximum preferred diameter. The flexible band includes an accessory connector for attaching accessories such as a scent container, holder, or electric fan. The accessory connector may include retaining posts or may alternatively include flanged retaining blocks. A scent container or other accessory may optionally include flanges, flanged retaining blocks, or other attachment means. An optional timer controls discharge from a spray container into a garment. An embodiment of the invention may optionally be provided together with garment such as a glove for a hand.

8 Claims, 8 Drawing Sheets

GARMENT BAND

CROSS REFERENCE TO RELATED APPLICATIONS

This application claims priority to U.S. Provisional Patent Application No. 61/741,219, filed Jul. 16, 2012, titled "Air loop drying ring (for gloves)", incorporated herein by reference in its entirety.

FIELD OF THE INVENTION

Embodiments of the invention are related generally to apparatus for shaping a garment and more particularly to apparatus for holding a damp garment open to enhance drying.

BACKGROUND

Drying a garment promptly and thoroughly after it becomes damp may prevent mildew or unpleasant odors from developing in the garment and may prevent the garment from stretching, shrinking, or wrinkling. Various supports, forms, hangers, and racks have been proposed for holding a garment in a preferred shape and for improving airflow around and into a wet garment to enhance drying. For example, devices referred to as glove forms or glove stretchers include elongate members for insertion through the wrist opening and into the fingers and thumb of a glove for a hand, shaping the glove and holding the glove open to improve drying. Hangers or racks may be shaped fit into openings on other types of garments, for example a wrist opening in a glove, a cuff or collar on a shirt or sweater, a waistband on a skirt or trousers, the opening for a head in a hat, the opening for a foot in a boot or shoe, etc., holding the garment open so that air flows into the inside of the garment.

Although forms, racks, and the like may facilitate efficient drying while holding the garment in a preferred shape, such devices may suffer from several problems. Some forms fit into only one type of garment and are not useful with other types of garments without substantial modification of the form. For example, a shoe form may be of little use for drying a stocking cap. Other devices fit within a narrow range of sizes for a garment. For example, a form for an adult's glove may not fit into a child's glove. Other devices are too large to fit into a pocket or purse or would take up too much room in a suitcase, making it difficult to carry such devices when travelling. Some devices require complicated bending, forming, or joining of separate parts, making them expensive to manufacture. Some devices have one shape for a glove for a right hand and another shape for a glove for a left hand, possibly doubling manufacturing tooling, assembly labor, and inventory costs. Other devices may damage a garment if inserted into the garment incorrectly or if the wrong size device is inserted into the garment.

SUMMARY

An example of an apparatus in accord with an embodiment of the invention includes a first end, a second end opposite the first end, and a loop inner surface. An accessory connector is attached to the loop inner surface. A loop connector is included near the first end of the flexible band. A closed loop is formed when the second end of the flexible band engages the loop connector.

In another example of an embodiment of the invention, an apparatus comprises an elongate flexible band having a first end, a second end opposite the first end, a loop inner surface, and a length. An accessory connector is attached to the loop inner surface and a loop connector is near the first end of the flexible band. In this example, the embodiment of the invention further includes a glove for a hand. A closed loop is formed when the second end of the flexible band engages the loop connector. A length of the flexible band is selected to give a maximum diameter for the closed loop that is greater than the size of an opening in the glove through which a hand may be inserted.

In yet another example of an embodiment of the invention, an apparatus includes an elongate flexible band having a first end, a tapered second end opposite the first end, a loop inner surface, a length, and a catch at the first end of the flexible band. The catch is formed with a rectangular catch aperture through the loop inner surface with a width of the catch aperture arranged in a transverse direction on the flexible band and a separation distance between opposite diagonal corners of the catch aperture greater than a width at the second end of the flexible band. The apparatus further includes a transverse ridge having a triangular profile with one transverse side perpendicular to the loop inner surface, the transverse ridge extending outward from the loop inner surface at the second end of the flexible band, a first retaining post attached to the loop inner surface between the first end of the flexible band and an edge of the catch aperture, and a second retaining post attached to the loop inner surface between the first end of the flexible band and the edge of the catch aperture. This example of an embodiment of the invention also includes a container for a scent medium formed with a pair of apertures sized for a sliding fit around the first and second retaining posts and formed with an additional plurality of apertures through at least one side of the container.

DESCRIPTION

An embodiment of the invention, also referred to herein as a garment band, comprises a flexible band made from a springy material selected for resistance to chemical attack by water, perspiration, and common soaps and detergents. The flexible band acts as a spring which, when formed into a loop and inserted into an opening into a damp garment, expands until the loop presses against the garment or until the loop attains a maximum diameter determined by the length of the garment band, allowing air to enter the opening in the garment and enhance drying of the garment. In some embodiments of the invention, an outer surface of the flexible band at an end of the band slides over the loop's inner surface, enabling the loop to self-adjust to hold open garments of different types and sizes. For example, in some embodiments a garment loop may be rolled into a self-adjusting loop that fits into the wrist opening of a glove for a child. The same garment loop may self-adjust to fit into the larger wrist opening of a glove for an adult.

In some embodiments of the invention, a loop connector for holding the garment band in a closed, self-adjusting loop comprises a transverse catch ridge near a first end of the flexible band. The catch ridge engages an edge of a catch aperture formed near a second end of the flexible band when the flexible band has expanded to its maximum diameter. The catch ridge may be easily disengaged from the catch to unfold the loop, thereby enabling a garment band to be unrolled and stored or carried flat rather than in a closed loop. A flat garment band may be easier to carry in a pocket or purse than a rolled garment band. Other embodiments of the invention use alternative means for forming a self-adjusting closed loop.

Embodiments of the invention are well suited for drying gloves and other articles of clothing which may become damp from water or perspiration. Garment bands in accord with an embodiment of the invention may be provided in lengths and widths to fit into hats, shirts, sweaters, trousers, gloves, stockings, outer footwear, and other articles of clothing, or sporting equipment such as boxing gloves, ski gloves, baseball gloves, wet suits, swimwear, fishing waders, and so on. Some embodiments of the invention include a garment and a garment band sized for use with the garment.

In contrast to a garment band in accord with an embodiment of the invention, forms, racks, hangers, and other devices previously known in the art may be difficult or even dangerous for a person to carry while they are working or engaged in a sports activity such as skiing or riding a bicycle. Prior art devices may be much more expensive to manufacture than embodiments of the invention. Furthermore, it may be impractical for cost or structural reasons to adapt prior art devices to introduce sanitizing or deodorizing agents into the interior of a garment.

Figure 1:
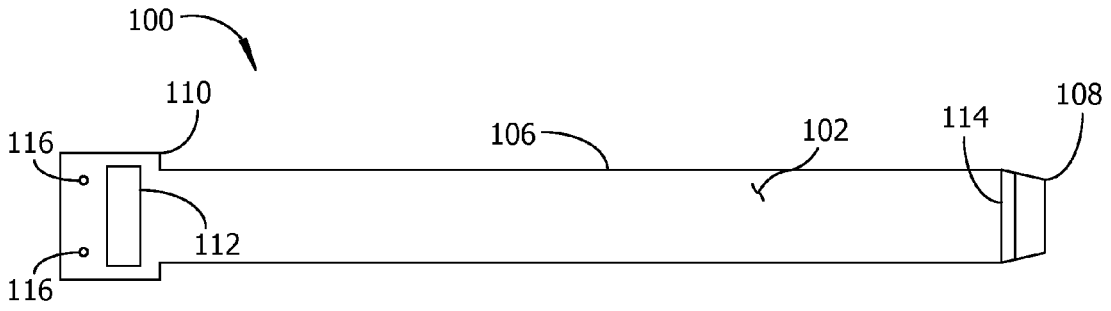
FIG. 1 shows an example of an embodiment of the invention unrolled flat with an inner loop surface facing the viewer.
Figure 18:
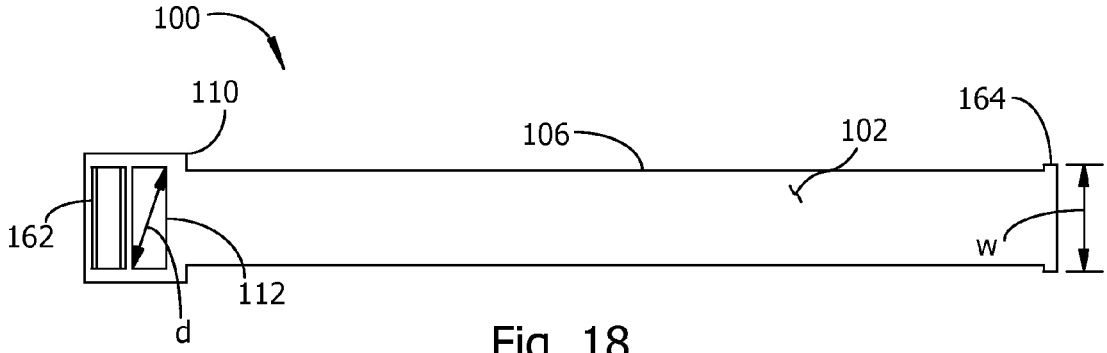
FIG. 18 shows a view toward the loop inner surface of an unrolled garment band having a holder for a scent medium and an example of a loop connector comprising a rectangular catch aperture near one end of the flexible band and a tab at an opposite end of the flexible band.

FIG. 1 shows a view toward a loop inner surface of an example of garment band in accord with an embodiment of the invention. In the example of FIG. 1, the garment band 100 is unrolled flat with the loop inner surface 102 facing the viewer. The loop outer surface, the side of the garment band 100 that preferably contacts a garment when the garment band is in use, is opposite the loop inner surface 102 on the side facing away from the viewer and is therefore not visible in FIG. 1. The example of a garment band 100 includes an elongate flexible band 106 having a loop connector comprising a catch 110 at a first end of the flexible band and a tapered end 108 at a second end of the band opposite the first end. A longitudinal dimension of the garment band 100 from the first end at the left side of the catch 100 in FIG. 1 to the second end at the right side of the tapered end 108 represents a length of the garment band 100. The length of the garment band 100 may determine a maximum diameter of a closed self-adjusting loop, or the maximum diameter may be determined by the type and location of loop connector used to hold the garment band in a closed loop. A width of part of garment band refers to a dimension in a direction transverse to the length of the garment band. Examples of width dimensions in a transverse direction are shown in FIG. 18 (width "w" of tab 164) ad FIG. 20 (widths "w1" and "w2" of flexible band 106).

In the example of FIG. 1, the loop inner surface and the loop outer surface are relatively flat and have an approximately rectangular shape. In alternative embodiments of the invention, either one or both of the inner and outer surfaces may be textured, ribbed, or carry one or more raised or depressed features. Deviations from a flat surface may permit air to flow between the garment band and parts of a garment in contact with the loop formed by the band. Texturing, ribbing, or raised or depressed features may optionally be selected for aesthetic appeal. For example, a garment band may be formed with raised or inset lettering or a raised or depressed graphic design for a ski resort or garment manufacturer. Furthermore, while the flexible band in the example of FIG. 1 is shown with straight sides, the band may be formed into any convenient elongate shape that may be formed into a ring. The lateral sides of the flexible band may be curved, vary in width along the length of the flexible band, be formed into an ornamental shape such as the shape of an animal or article of sporting equipment, and so on. For example, the flexible band may be formed in the shape of a fish, a bird, a snowboard, or other shapes, or printed, embossed, or raised indicia may be placed on either surface of the flexible band.

A garment band embodiment of the invention is formed from a material which is flexible enough to be rolled into a closed loop yet stiff enough that the loop self-expands to a diameter limited by the size of an opening in a garment, by the length of the garment band, or by the design of the loop connector, whichever limit is reached first. The material of the garment band is preferably stiff enough to generate sufficient spring force to expand against the weight and stiffness of the garment. For example, a garment band intended for use with a boxing glove may be stiffer and generate more spring force for holding the glove open than a garment band intended for use with a lightweight mitten. The stiffness of a garment band may be altered by, for example but not limited to, changing the material of the garment band, changing a thickness or profile shape of the garment band over some or all of its length, adding surface projections such as ridges or ribs to the garment band, and so on. Examples of materials suitable for making an embodiment of the invention include, but are not limited to, plastic compounds including polyethylene, spring steel, and steel or other flexible metal covered with a plastic laminate or other corrosion-resistant coating, and composite materials.

Figure 10:
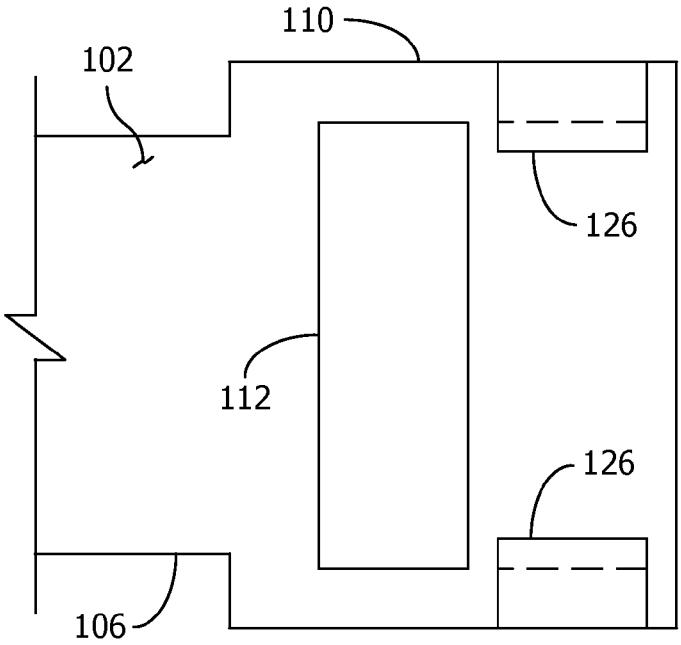
FIG. 10 shows a partial view of an alternative example of an accessory connector comprising flanges for retaining a removable container.
Figure 11:
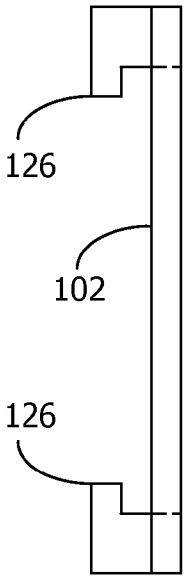
FIG. 11 is an end view of the example of FIG. 10.
Figure 14:
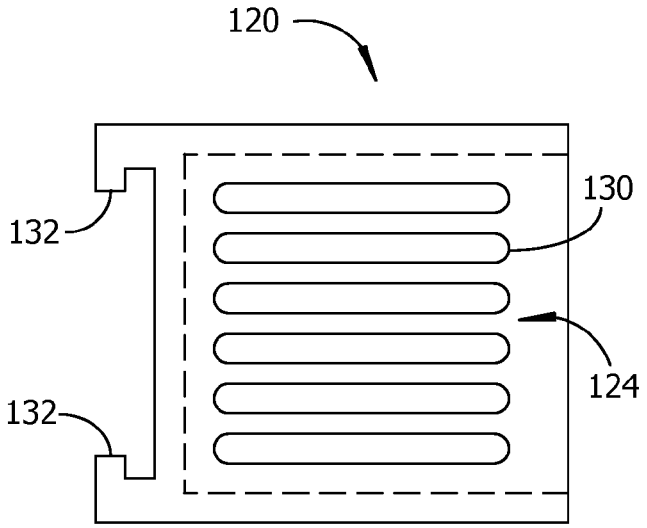
FIG. 14 is a side view of another example of an accessory comprising a container with flanged blocks for slidably gripping opposite longitudinal sides of a flexible band or loop connector
Figure 15:
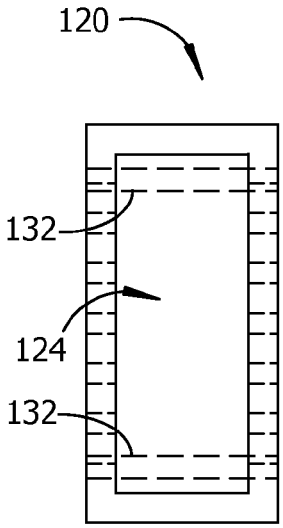
FIG. 15 is a view toward an open end of the example of a container from FIG. 14.
Figure 16:
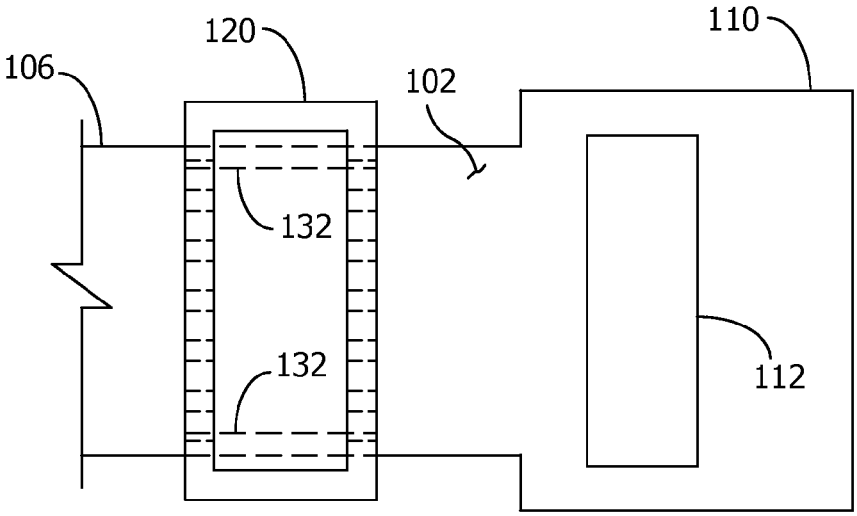
FIG. 16 shows the example of the container from FIGS. 14 and 15 connected to a flexible band.

Continuing with the example of a garment band 100 in FIG. 1, the catch 110 is formed with a catch aperture 112 sized to admit a width of the flexible band 106. The width of the catch aperture 112 is in a transverse direction relative to the garment band 100. An accessory connector for attaching accessories to the garment band 100 may optionally be included on the catch or elsewhere on the garment band. In the example of FIG. 1, a first retaining post 116 projecting outward from the loop inner surface 102 (i.e., toward the viewer) and an optional second retaining post 116 are examples of an accessory connector. Alternative embodiments of the invention may use other types of accessory connectors, for example, but not limited to, flanges, snaps, hook-and-loop fastener material, rivets, twist locks, threaded fasteners, and so on. FIGS. 10-11 show an example of an accessory connector comprising an opposing pair of flanges. FIGS. 14-16 show another alternative example of an accessory connector comprising opposing flanges on an accessory.

Figure 20:
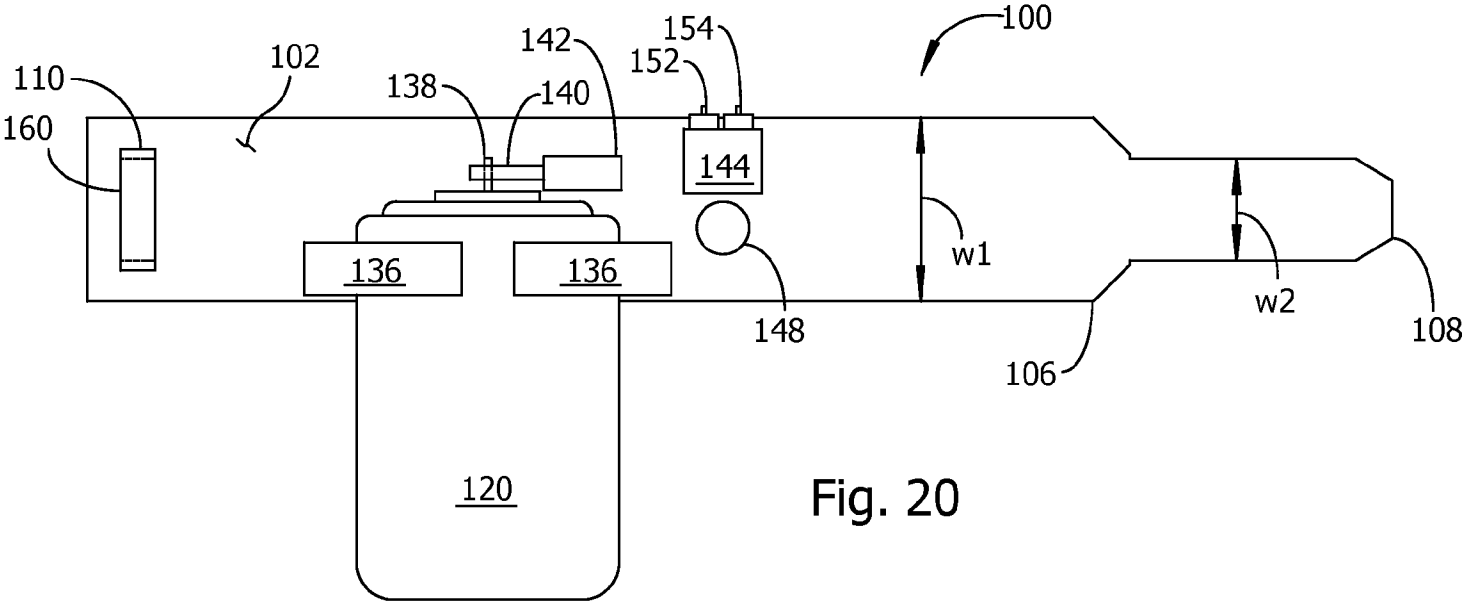
FIG. 20 shows an example of an alternative embodiment of the invention fitted with a timing device and an actuator for dispensing a scent, disinfectant, or other liquid or gaseous agent into a garment.

In the example of FIG. 1, a catch ridge 114 located near the second end of the garment band 100 projects outward from the loop inner surface 102. The catch ridge 114 may alternatively be positioned on the tapered section as shown in FIG. 1, at the extreme limit of the second end, or near the second end but outside the tapered section. Alternative embodiments of the invention may use other forms of a loop connector for holding the garment band in a closed, self-adjusting loop. For example, instead of a loop connector having a catch ridge that engages an edge of a catch aperture as previously described, a loop connector may comprise an end of the band sized to pass through an aperture in a transverse retaining loop projecting outward from the loop inner surface, an example of which is shown in FIG. 20. In the example of FIG. 20, the tapered end 108 of the flexible band 106 has a width selected to pass through an aperture formed by the retaining loop 160 and the loop inner surface 102. Alternatively, the retaining loop may be formed as a separate part that partially or entirely surrounds the garment band and slides along the garment band.

Figure 2:
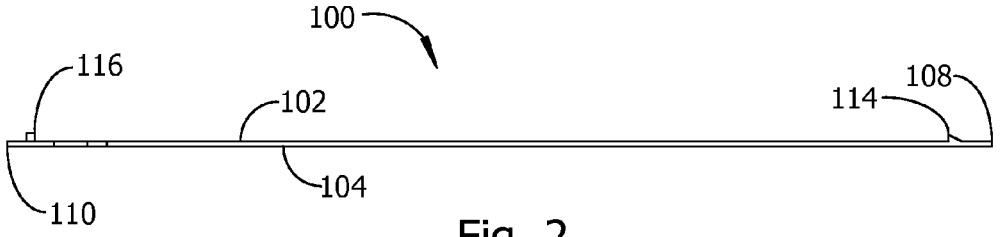
FIG. 2 is a side view of the example of FIG. 1.

The example of a garment band 100 from FIG. 1 is shown in a side view in FIG. 2. The projected edges of the loop inner surface 102 and loop outer surface 104 are separated by a thickness dimension of the garment band 100. In the example of FIG. 2, the thickness of the garment band is uniform along its entire length. In alternative embodiments of the invention, the thickness of the flexible band or other parts of the garment band may vary along their length. In the example of FIG. 2, the retaining posts 116 project outward from the loop inner surface 102 on the catch 110, although the retaining posts may alternatively be located at any convenient position along the length of the garment band 100. The catch ridge 114, shown with a triangular profile in the example of FIG. 2, projects outward from the loop inner surface 102 near the tapered end 108. A catch ridge may alternatively have a different profile shape than the example of a profile shape in FIG. 2, for example square, rounded, curved, or rectangular.

Figure 3:
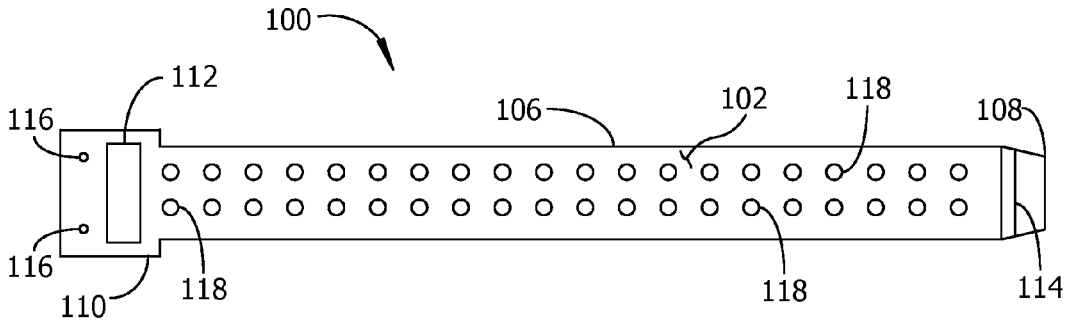
FIG. 3 shows an alternative embodiment of the invention having airflow apertures through the inner and outer loop surfaces of the flexible band.

A garment band 100 may optionally be formed with ventilation apertures through the flexible band 106. Ventilation apertures may enhance drying of parts of garment in contact with a garment band. FIG. 3 shows an example of a flexible band 106 formed with ventilation apertures 118. Ventilation apertures 118 may be formed with a circular perimeter as suggested in FIG. 3, or may alternatively be formed as slots or holes of other shapes, including ornamental shapes.

Figure 4:
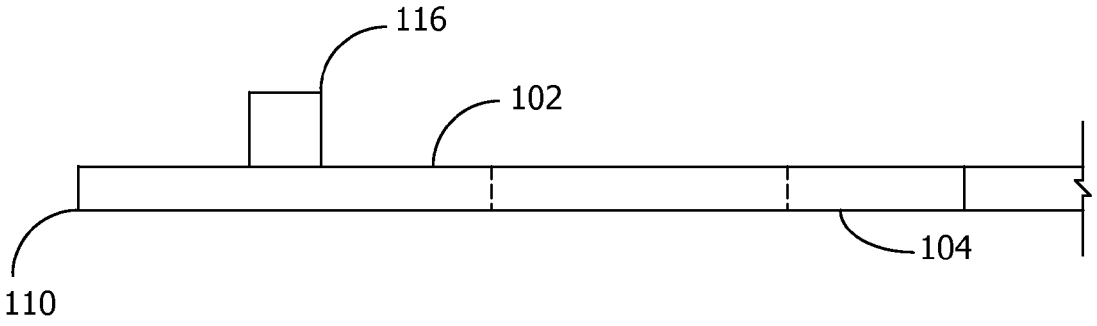
FIG. 4 is a partial enlarged side view of the examples of FIGS. 1 and 3, showing a retaining post as an example of an accessory connector.
Figure 5:
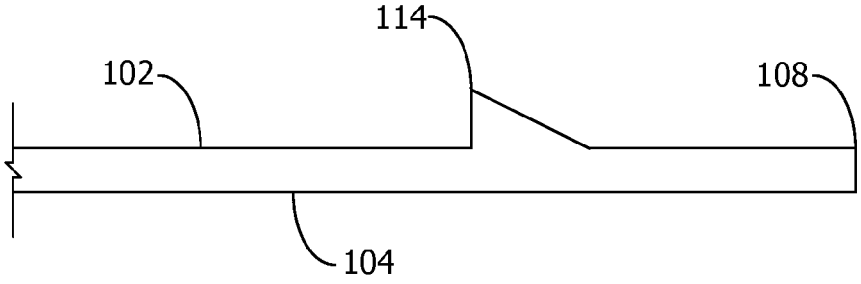
FIG. 5 is a partial enlarged side view of the examples of FIGS. 1 and 3, showing an example of a catch ridge for holding a garment band in a closed loop.

FIG. 4 shows an enlarged view of the example of an accessory connector from FIG. 2, including retaining post 116 and parts of the loop inner surface 102 and loop outer surface 104 on the catch 110. FIG. 5 shows an enlarged view of an example of a catch ridge 114 near the tapered end 108 of the garment band. In the example of FIG. 5, the catch ridge is formed as an integral part of the garment band and has a triangular profile. The triangular profile of the catch ridge may optionally be formed with one transverse side perpendicular to the loop inner surface, preferably the side facing away from the tapered end 108.

In alternative embodiments of the invention, the catch ridge may be omitted and the flexible band may be retained in the catch by other means. For example, the flexible band may have a segment near one end that is too wide to pass through the width of the catch aperture but narrow enough to pass through when turned along a diagonal of the catch aperture. An example of an embodiment of the invention 100 having a tab 164 which prevents the end of the flexible band 106 from inadvertently slipping through a catch aperture is shown in FIG. 18. In the example of FIG. 18, the width "w" of the tab 164 is less than the dimension "d" across diagonally opposite corners of the catch aperture 112, but greater than the transverse width of the catch aperture.

Figure 6:
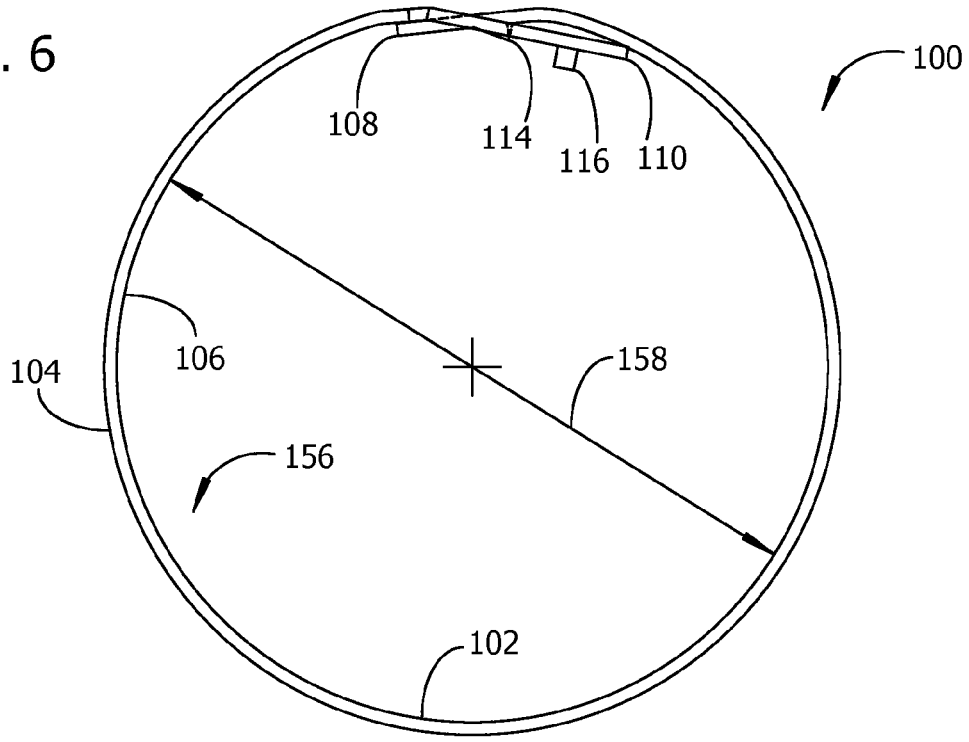
FIG. 6 shows a side view of an example of a garment band formed into a closed, self-adjusting loop, expanded to a maximum loop diameter and held closed by a loop connector.

Some embodiments of a garment band may be formed into a closed loop by passing an end of the garment band through an aperture in a catch on the band. An example of a garment band 100 held in a closed loop at is maximum diameter by a loop connector is shown in the example of FIG. 6. In the example of FIG. 6, the catch ridge 114 is in contact with an edge of the catch aperture formed in the catch 110, thereby holding the closed loop 156 at its maximum diameter 158. The diameter of the closed loop 156 may be reduced by sliding the loop outer surface of the tapered end 108 along the loop inner surface 102 of the flexible band 106. Compressing the closed loop may make it easier to insert the garment band 100 into an opening in a garment. The garment band 100 is preferably sufficiently springy to hold a garment open without causing damage to the garment and without the loop collapsing under the weight of the garment. When inserted into a garment, the loop outer surface 104 contacts the garment to hold the garment open for air to enter the garment through the loop.

Figure 7:
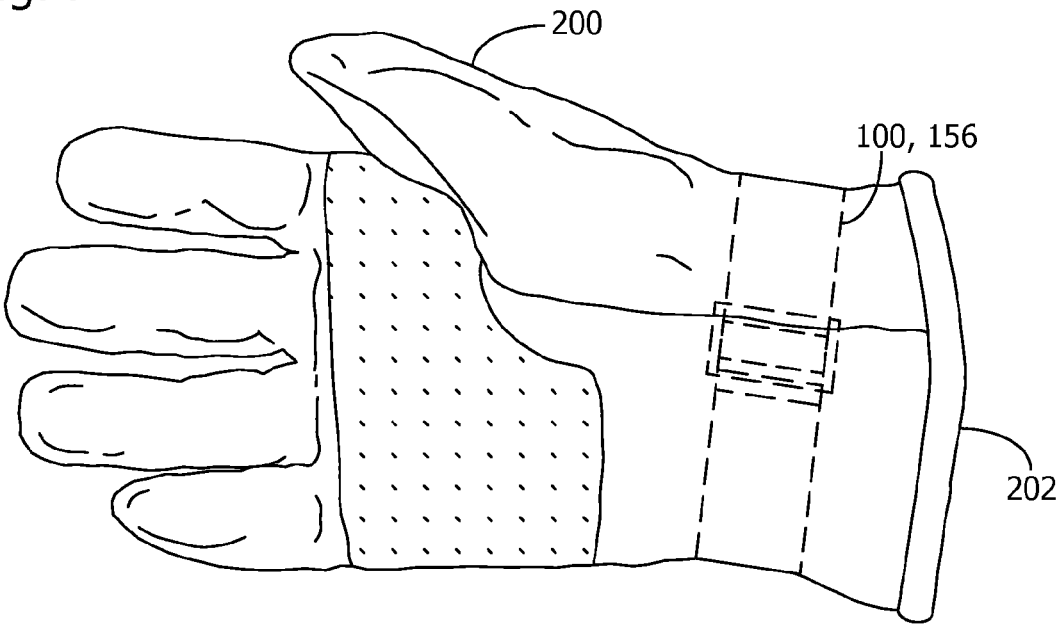
FIG. 7 shows an example of an embodiment of the invention positioned inside a wrist opening of a glove for a right hand, an example of a garment to be dried.

FIG. 7 shows an example of a heavy work glove 200 with an example of a garment band 100 positioned inside the glove near the wrist opening 202. The garment band 100 is shown expanded and holding the sides of the wrist opening 202 apart to admit ventilating air into the interior of the glove trough the loop. A length of the flexible band may be selected to give a maximum diameter for the closed loop that is greater than the size of an opening in the glove through which a hand may be inserted, thereby ensuring the loop will press against the sides of the opening and hold the glove open. If the flexible band is too short, the opening in the glove may be larger than the maximum diameter of the closed loop formed by the flexible band and air flow into the glove may be reduced. Refer to FIG. 6 for an example of maximum diameter 158 of the closed loop 156.

In the example off FIG. 7, the garment band 100 has expanded until parts of the glove in contact with the garment band conform to the shape of the garment band's outer loop surface. The example of a garment band 100 in FIGS. 6-7 is suitable for use with either a glove for a left hand or a glove for a right hand. Embodiments of the invention disclosed herein may easily be adapted for use with garments other than gloves by changing the dimensions and optionally the material of the garment band to fit a preferred range of garment sizes and types. For example, an embodiment of the invention having a length suitable for use in the collar of a sweater may also be useful for holding open a sleeve of the sweater or the opening of a stocking cap.

Figure 8:
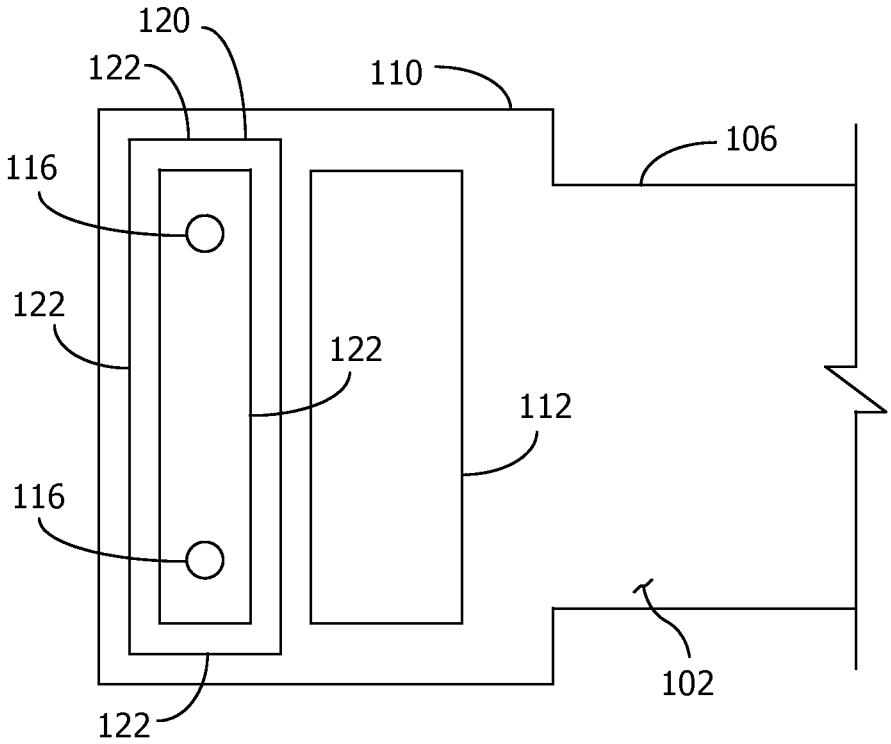
FIG. 8 shows a partial view of a loop connector and an accessory in the form of a container for holding a scent medium.
Figure 9:
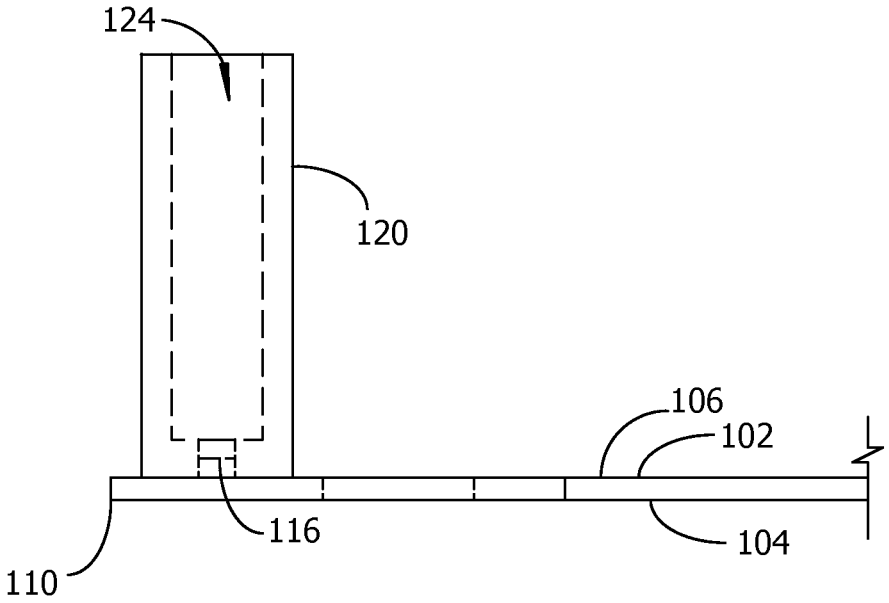
FIG. 9 is a side view of the example of FIG. 8.

An embodiment of the invention may include an accessory in the form of a container or holder for introducing a deodorizing or disinfecting agent into the interior of a garment while the garment is drying. The container or holder may hold a scent medium such as a solid deodorizing tablet, an absorbent pad into which a liquid with a volatile deodorizing or sanitizing component has been introduced by a user of the garment ring, or a scent medium with a preloaded scent agent, for example a scented cardboard ornament. The container may optionally be formed from a relatively soft, flexible material that grips a deodorizing tablet or absorbent pad, yet allows the tablet or pad to be extracted when the active volatile agent is exhausted. An example of an accessory represented by a container 120 is shown in FIGS. 8-9. The open end of the container 120 may be accessible from the loop inner surface 102 as suggested in FIG. 9. Container walls 122 define a pocket 124 into which a tablet, pad, or other medium for a scent, deodorant, or disinfectant may be introduced. In the illustrated example, the container is positioned between the catch aperture 112 and the end of the catch 110, but the container may alternatively be positioned in any convenient location along the length of the flexible band 106. The container 120 may be mechanically attached to the garment band by a close sliding fit between retaining posts 116 on the catch 110 and corresponding apertures formed in the container. The container 120 may optionally be formed as an integral part of the garment band.

Figure 12:
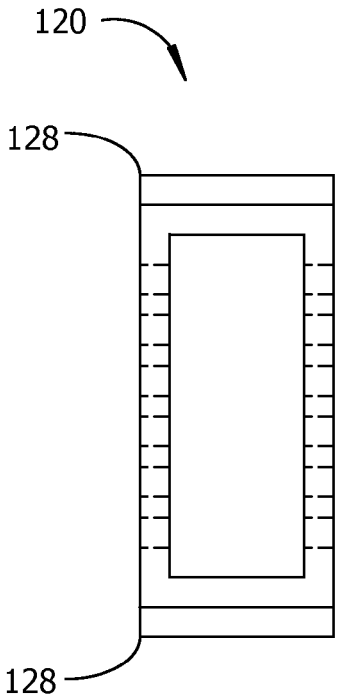
FIG. 12 is a view toward an open end of an example of a container with flanges, another example of an accessory suitable for use with an embodiment of the invention.
Figure 13:
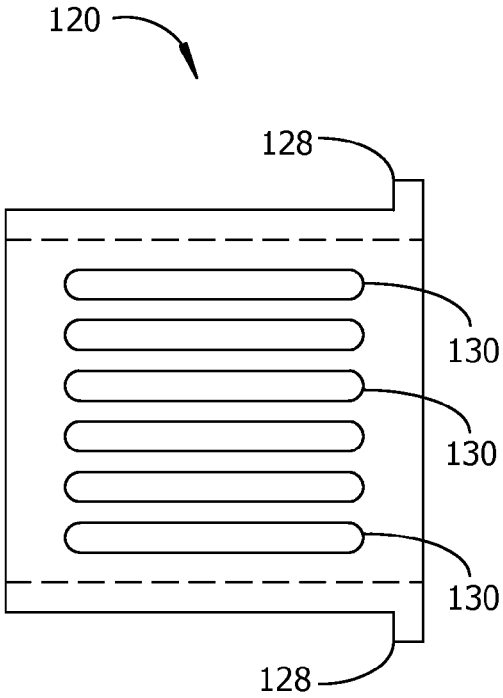
FIG. 13 is a side view of the example of a container from FIG. 12.

In an alternative embodiment of the invention, a container includes flanges for slidably engaging an accessory connector comprising flanged retaining blocks on the loop inner surface of the garment band, as suggested in the examples of FIGS. 10-13. Flanges 128 on the container 120 are sized for a sliding fit between the flanged retaining blocks 126 and the loop inner surface 102. The flanged retaining blocks 126 may be positioned between the catch aperture and the first end of the garment band as suggested in FIG. 10, or the flanged retaining blocks 126 may alternatively be positioned at any convenient location along the length of the flexible band 106. Flanges 128 on the container 120 are shown in FIGS. 12-13. FIGS. 12-13 further illustrate an example of a container 120 formed with ventilation apertures 130 passing though the sides of the container.

An alternative embodiment of a container includes flanged retaining blocks for gripping opposite lateral sides along the length of a flexible band 106 or optionally for gripping opposite lateral sides of the catch 110. FIGS. 14-15 show an example of an accessory including an accessory connector comprising flanged retaining blocks. FIG. 16 shows an example of a position for the container 120 with the flanged retaining blocks 132 gripping opposite lateral sides of the flexible band 106. The flanged retaining blocks 132 on the container 120 may optionally be sized for a sliding fit along the flexible band 106 or catch 110. The container may optionally be formed with a pocket 124 having an opening accessible from the loop inner surface 102 side of the garment band 100. A scent medium such as a scent tablet, scented card or strip, or scented pad of absorbent material, may be placed in the pocket 124.

Figure 17:
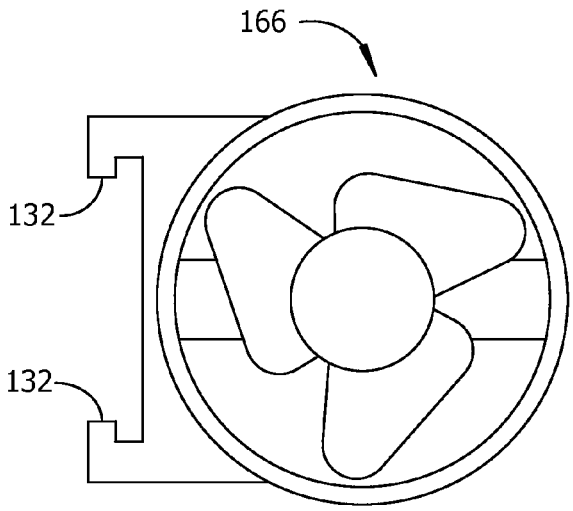
FIG. 17 illustrates a battery-powered or solar-powered fan or blower, another example of an accessory suitable for use with an embodiment of the invention.

An embodiment of the invention may optionally include an accessory for forcing air into a garment through the rolled garment band. FIG. 17 shows an example of a fan 166 having flanged retaining blocks for engaging opposite lateral sides of a flexible band. The fan may be powered by a battery connected to the fan housing or by a photovoltaic panel on an outer surface of the fan housing. The fan 166 may alternatively be provided with flanges that engage a corresponding accessory connector comprising flanged retaining blocks on the garment band.

Figure 19:
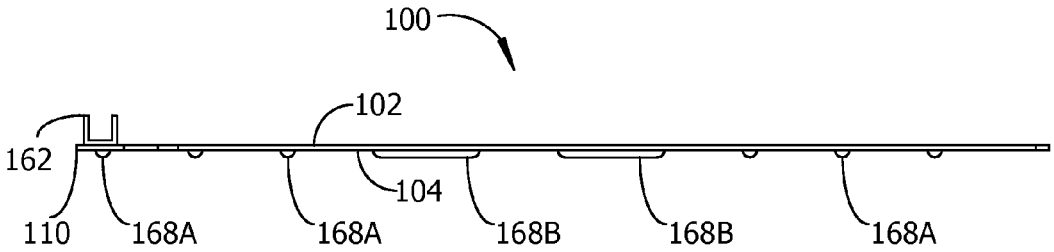
FIG. 19 is a side view of the example of a garment band and holder from FIG. 18, further illustrating an example of surface projections extending outward from the loop outer surface.

FIGS. 18-19 show an example of another accessory for holding a scent medium. The example of a holder comprises a base in contact with the loop inner surface 102 and two parallel walls attached to opposite sides of the base and extending outward from the loop inner surface, thereby forming a U-shaped holder 162. The walls and base of the U-shaped holder 162 form a channel into which a scent medium such as a scent table or pad of absorbent material may be held. In the illustrated example, the longest edge of the U-shaped holder 162 is positioned transversely on the catch 110. The U-shaped holder may alternatively be positioned transversely anywhere along the length of the flexible band 106. The U-shaped holder 162 may be formed as an integral part of the garment band 100, formed separately and permanently attached to the garment band, or removably attached by one of the accessory connectors previously described for the container and fan accessories.

FIG. 19 shows examples of optional surface projections with project outward from the outer loop surface 104 of the example of a garment band 100. The surface projections allow air to flow between the outer loop surface and parts of a garment in contact with the garment band, enhancing drying of the garment near the garment band. Examples of surface projections include, but are not limited to, bumps 168A, ridges 168B, ornamental shapes, raised text, and the like. The size, shape, and position of each surface projection may optionally be selected to enhance drying of a particular type of garment.

Some embodiments of the invention include a means for dispersing a sprayed deodorizing, perfuming, or disinfecting agent into a garment. For example, the accessory connector on the garment band 100 in FIG. 20 has been implemented as a pair of retaining clips 136 attached to the loop inner surface 102 of the flexible band 106. The retaining clips 136 hold a container 120. The container 120 in the example of FIG. 17 is representative of a container that holds a fluid and propellant gas under pressure and which emits a mist, stream, or droplets when a valve actuator is moved to operate a valve in the container, and may also represent a container with a manually pumped spray nozzle, either of which will be referred to herein as a spray container. Some embodiments of the invention include a container 120. Alternatively, the garment band 100 may be provided without a container but may accept an spray container provided by a user of the garment band. The retaining clips 136 may be positioned at any convenient location along the length of the flexible band 106. The valve actuator 138, part of the container 120, is operated by a solenoid shaft 140 on a solenoid 142 connected to an output 146 from a timer 144. At selected time intervals, the timer 144 operates the solenoid 142 to release a burst of spray from the container 120.

Figure 21:
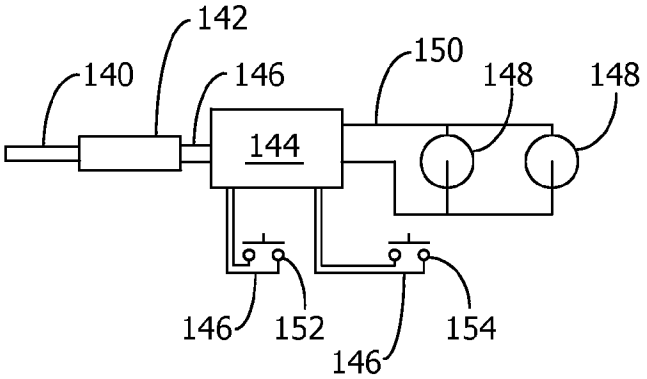
FIG. 21 is a simplified schematic diagram of electrical connections between examples of a solenoid, timer, and other electrical components from FIG. 20.

In some embodiments of the invention, the timer 144 may be a mechanical or electromechanical device. Alternatively, the timer 144 may be implemented as an electrical timing circuit, as shown in the example of an electrical schematic in FIG. 21. For example, the timer 144 may be a microcontroller implemented as a semiconductor hardware device having an output suitable for driving a solenoid. A power on/off switch 152 and a timer interval setting switch 154 may be electrically connected to the timer 144 by electrical connections 146. One or more electrical storage batteries, for example coin cells 148, may provide electrical power to the timer 144 and solenoid 142 through electrical power connections 150. Embodiments of the invention may optionally be powered by other types of batteries than the coin cells in the example of FIGS. 20-21.

Unless expressly stated otherwise herein, ordinary terms have their corresponding ordinary meanings within the respective contexts of their presentations, and ordinary terms of art have their corresponding regular meanings.

What is claimed is:

1. An adjustable, automatically enlarging loop forming apparatus for an object with an flexible opening, said apparatus comprising:

an elongated flexible band having a first end, a second end opposite said first end, an inner surface and an outer surface, said flexible band configured so that when said second end slides under and overlaps said first end a closed loop is formed, said flexible band is made of material that enables it to form different size closed loops by manually forcing said second end under said first end and sliding said outer surface of said flexible band adjacent to said second end and against said inner surface of said flexible band adjacent to said first end, said flexible band expands and automatically returns to its original shape and increases the diameter of said closed loop when the manual force is removed;

a catch aperture formed near said first end of said flexible band, said catch aperture configured to receive said second end of said flexible band and allows said second end to slide under said first end and keep said flexible band configured in a closed loop, said catch aperture includes a transversely aligned front edge and a transversely aligned rear edge, said catch aperture configured to receive said second end of said flexible band when said second end extends over said first end and slides under said inner surface of said flexible band to form a said closed loop;

a catch ridge located on said inside loop surface of said flexible band near said second end, said catch ridge configured to abut said rear edge of said catch aperture when said second end is inserted into said catch aperture, said catch ridge located inward from said second end of said flexible strap so that when said flexible band expands and returns to its original shape, said second end slides outward through said catch aperture and said catch ridge abuts said rear edge of said catch aperture and prevents said second end from disengaging from said catch aperture; and, wherein when said second end of said flexible band is inserted into said catch aperture and manually forced inward to form a narrow closed loop and then placed inside an opening formed on a flexible object and said second end is released, said flexible band automatically expands forcing the flexible opening on said object to expand to allow air to enter said object whereby airflow is enhanced.

2. The apparatus of claim 1, further comprising a deodorizing agent dispersed on said flexible strap.

3. The apparatus of claim 2, further comprising a container filled with said deodorizing agent.

4. The apparatus of claim 1, further comprising a fan attached to said accessory connector.

5. The apparatus of claim 1, wherein said accessory further includes a retaining post projecting outward from said loop inner surface.

6. The apparatus of claim 1, wherein said accessory further including pair of opposing flanged retaining blocks attached to said inner surface.

7. An apparatus for holding the hand opening formed on a glove in an open configuration, said apparatus, comprising:

an elongate flexible band having a first end, a second end opposite said first end, a loop inner surface, said flexible band made of material that enables it to bend and form a closed loop and sufficiently stiff to automatically expand and unroll, said flexible band configured to form a closed loop sufficient in diameter to be inserted into said hand opening on said glove;

a catch ridge formed or attached to said loop inner surface and near said second end;

a catch aperture located near said first end of said flexible band configured to receive said second end of said flexible strap to form a closed loop, said catch ridge engages said catch aperture to maintain said flexible strap in a close loop, and;

wherein when said second end is inserted into said catch aperture and manually forced inward to form a closed loop sufficient in diameter to fit into the hand opening on said glove and then released, said flexible band automatically slides outward through said catch aperture and increases the diameter of said closed loop and expands said hand opening enabling air to enter and circulate inside said glove whereby drying is enhanced.

8. The apparatus of claim 7, further comprising a deodorizer dispersed on said flexible strap.

* * * * *